US009334553B2

(12) United States Patent
Peker et al.

(10) Patent No.: US 9,334,553 B2
(45) Date of Patent: May 10, 2016

(54) ZIRCONIUM BASED BULK METALLIC GLASSES

(71) Applicants: Atakan Peker, Spokane, WA (US); Dongchun Qiao, Spokane, WA (US)

(72) Inventors: Atakan Peker, Spokane, WA (US); Dongchun Qiao, Spokane, WA (US)

(73) Assignee: Washington State University, Pullman, WA (US)

( * ) Notice: Subject to any disclaimer, the term of this patent is extended or adjusted under 35 U.S.C. 154(b) by 538 days.

(21) Appl. No.: 13/847,759

(22) Filed: Mar. 20, 2013

(65) Prior Publication Data

US 2013/0255837 A1 Oct. 3, 2013

Related U.S. Application Data

(60) Provisional application No. 61/617,207, filed on Mar. 29, 2012.

(51) Int. Cl.

| | |
|---|---|
| ***C22C 45/10*** | (2006.01) |
| ***C22C 16/00*** | (2006.01) |
| ***C22C 45/00*** | (2006.01) |
| ***C22C 1/00*** | (2006.01) |

(52) U.S. Cl.

CPC ..... *C22C 45/10* (2013.01); *C22C 1/002* (2013.01); *C22C 16/00* (2013.01); *C22C 45/001* (2013.01)

(58) Field of Classification Search

None

See application file for complete search history.

(56) References Cited

U.S. PATENT DOCUMENTS

| | | | | |
|---|---|---|---|---|
| 5,032,196 | A | 7/1991 | Masumoto et al. | |
| 5,288,344 | A | 2/1994 | Peker et al. | |
| 5,618,359 | A | 4/1997 | Lin et al. | |
| 5,735,975 | A | 4/1998 | Lin et al. | |
| 6,521,058 | B1 | 2/2003 | Inoue et al. | |
| 6,652,673 | B1 | 11/2003 | Inoue et al. | |
| 6,682,611 | B2 * | 1/2004 | Zhang | C22C 45/10 148/403 |
| 6,709,536 | B1 | 3/2004 | Kim et al. | |
| 6,805,758 | B2 * | 10/2004 | Wolter | C22C 45/10 148/403 |
| 7,008,490 | B2 | 3/2006 | Peker | |
| 7,147,727 | B2 * | 12/2006 | Kim | C22C 30/02 148/304 |
| 7,368,023 | B2 | 5/2008 | Chang et al. | |
| 2012/0073707 | A1 * | 3/2012 | Gong | C22C 1/002 148/403 |
| 2012/0298264 | A1 | 11/2012 | Yi et al. | |
| 2013/0032252 | A1 | 2/2013 | He et al. | |
| 2013/0105300 | A1 | 5/2013 | Jang et al. | |

OTHER PUBLICATIONS

Office Action issued in U.S. Appl. No. 13/847,773 on Sep. 30, 2015, 12 pages.

Notice of Allowance issued in U.S. Appl. No. 13/847,773 on Feb. 1, 2016, 6 pages.

* cited by examiner

*Primary Examiner* — George Wyszomierski

(74) *Attorney, Agent, or Firm* — Liang IP, PLLC

(57) ABSTRACT

Various embodiments of zirconium based bulk metallic glass are described herein. In one embodiment, an alloy composition includes zirconium (Zr), copper (Cu), aluminum (Al), at least one element from a group consisting of niobium (Nb) and titanium (Ti), and at least one element from a group consisting of nickel (Ni), iron (Fe), and cobalt (Co).

21 Claims, No Drawings

ZIRCONIUM BASED BULK METALLIC GLASSES

CROSS-REFERENCE TO RELATED APPLICATION(S)

This application claims priority to U.S. Provisional Patent Application No. 61/617,207, filed on Mar. 29, 2012.

STATEMENT REGARDING FEDERALLY-SPONSORED RESEARCH

This work was made with support provided by the U.S. Department of Defense. The U.S. government has certain rights in the invention.

BACKGROUND

Metallic glasses are metallic alloys that have a glassy phase with an amorphous atomic structure in a solid state. The glassy phase is believed to be a metastable phase and not a thermodynamically stable phase in a solid state. As a result, metallic glasses are typically formed by quenching from a liquid state to reduce or even avoid nucleation and growth of crystalline phases during solidification. As a result, casting large articles of metallic glasses may be difficult because large articles may not be quenched at sufficiently high rates.

DETAILED DESCRIPTION

Various embodiments of zirconium based bulk metallic glasses, methods of manufacturing such metallic glasses, and articles formed from such metallic glasses are described below. Certain example compositions, methods, and articles of manufacture are described below with particular components and operations for illustration purposes only. Other embodiments in accordance with the present technology may also include other suitable components and/or may operate at other suitable conditions. A person skilled in the relevant art will also understand that the technology may have additional embodiments, and that the technology may be practiced without several of the details of the embodiments described below.

Overview

As discussed above, casting large articles of metallic glasses may be difficult because large articles may not be quenched at sufficiently high cooling rates. A characteristic value of metallic glasses is a "critical cooling rate" of a metallic alloy to form an amorphous (or glassy) phase. The critical cooling rate is a minimum cooling rate required to avoid significant nucleation and growth of one or more crystalline phases during solidification. As such, a critical cooling rate is considered as a measure of glass forming ability of an alloy. Thus, a lower critical cooling rate indicating higher glass forming ability of an alloy.

A "critical cooling rate" can also be related to a "critical casting thickness," which may be defined as the upper bound value for the smallest section thickness of a cast article that can be formed into an amorphous phase. For example, for long cylindrical rod castings, a critical casting thickness may be the largest rod diameter that can be cast into an amorphous phase. When critical cooling rates are less than about 1,000 K/sec, corresponding glass forming alloys may have sufficiently high critical casting thicknesses that such alloys may be referred to as "bulk metallic glasses" suitable for casting into three-dimensional metallic glass objects.

Alloy formulations of bulk metallic glasses are believed to be associated with deep eutectic regions in respective phase diagrams. Therefore, such alloy formulations generally include substantial amount of crystalline intermetallic phases in a thermodynamically stable form or when becoming devitrified. The intermetallic phases typically have complex unit cell structures and may be very brittle. While the glassy phase in a metal is generally considered a high strength phase, the metal may exhibit brittle behavior in the presence of such crystalline intermetallic phases. When the critical cooling rate is not achieved throughout or marginally achieved in a cast article, the above-mentioned intermetallic phases may form and/or precipitate in a glassy matrix of the cast article.

Accordingly, formation of intermetallic phases may lead to a dramatic loss of structural strength and can cause premature fracture and failure of cast articles during subsequent manufacturing operations or service. For example, an alloy having a formula of Zr57Nb5Cu15.4Ni12.6Al10 commonly known as Vitreloy-106 has a glassy phase associated with a high strength (~1.5 GPa yield strength) and a reasonable toughness (~20 MPa-m½). However, when Vitreloy-106 is cast and solidified at rates lower than its critical cooling rate, crystalline intermetallic phases may form and render resulting cast articles brittle. It is not unusual that the elastic strain limit of Vitreloy-106 drops below 0.2%, fracture strength below 0.5 GPa, and fracture toughness less than ~5 MPa-m½, when cast and solidified at rates lower than its critical cooling rate.

The brittleness can pose challenges to high volume production of cast articles of bulk metallic glasses. For example, small changes in processing conditions can lead to reduced cooling rates, and preclude the achievement of critical cooling rate throughout of a cast article of bulk metallic glass. Alternatively, small changes in alloy preparation and formulation, and/or inclusion of impurities (e.g. higher oxygen content) may substantially increase the critical cooling rate. Under these conditions, brittle crystalline phases (e.g., intermetallic phases) can form and harm structural integrity of cast articles of bulk metallic glasses. Typically, confirming a full amorphous phase in a cast article using a practical or low-cost non-destructive technique may be difficult. As a result, quality control and assurance of high-volume production of cast articles from bulk metallic glasses post a challenge.

Several embodiments of the present technology are directed to alloy formulations of zirconium-based bulk metallic glasses that have resistance to brittleness upon partial or marginal achievement of the critical cooling rate in cast articles. The inventors have recognized that the alloys of the present technology have surprising properties when compared to conventional alloys. First, cast articles of certain alloys of zr-based bulk metallic glass of the present technology exhibit much higher resistance to brittleness when being cast and solidified at rates less than the critical cooling rate to form substantially fully amorphous cast article. Thus, embodiments of alloys of the present technology can be more tolerant to process control issues to facilitate high volume production of bulk metallic glasses. Secondly, the alloys of the present technology can be cast into still larger objects than corresponding critical casting thickness as casting cores, where cooling rate is the lowest. Thus, the alloys are less likely to form brittle intermetallic phases and may not compromise structural integrity of the cast article due to brittleness.

The inventors have surprisingly recognized that certain alloys of zirconium-based bulk metallic glasses are more resistant to brittleness when being cast and solidified at rates less than their critical cooling rate than other alloys. When being cast and solidified at rates more than the critical cooling rate, the alloys of the present technology readily form a bulk glassy phase to result in cast articles of substantially fully amorphous phase. The amorphous phase of such cast articles, cooled at rates higher than the critical cooling rate, has a high strength (about 1.5 GPa or more yield strength), a high elastic strain limit (about 1.8%) and a reasonable toughness (≥20 MPa-$m^{1/2}$).

When being cast and solidified at rates at the margin of critical cooling rate, the alloys of the present technology form a substantially glassy phase in portions with higher cooling rates and a mixture of glassy and crystalline phases in portions with lower cooling rates. The cast article still has a high strength (≥1.2 GPa), a high elastic strain limit (≥1.2%) and a reasonable fracture toughness (≥15 MPa-$m^{1/2}$) in the portions of mixed glassy and crystalline phases and throughout the cast article.

When being cast and solidified at still lower cooling rates than the critical cooling rate, e.g., at cooling rates from about 30% to about 200% of the critical cooling rate, the alloys of the present technology form substantially glassy phase in portions with the highest cooling rate, rates meeting or exceeding the critical cooling rate, and a mixture of glassy and crystalline phases in portions with lower cooling rate, rates at the margin or slightly less than the critical cooling rate, and substantially crystalline phases in portions with the lowest cooling rate, rates significantly less than the critical cooling rate. The resulting cast article still has a high strength (≥0.8 GPa), a high elastic strain limit (~1.0%) and a reasonable fracture toughness (≥10 MPa-$m^{1/2}$) in the portions of mixed phases or substantially crystalline phases and throughout the cast article. The crystalline phases, or the mixture of glassy and crystalline phases, formed in cast articles of the present technology have higher strength and toughness than those crystalline phases, or the mixture of glassy and crystalline phases, formed of conventional zirconium-based bulk metallic glasses. As a result, the crystalline portions or precipitates in the cast articles of the present technology have a limited or even no impact on brittleness, which is detriment to the structural integrity of the casting.

Furthermore, the inventors have recognized that the alloys of zirconium-based bulk metallic glasses can provide resistance to brittleness upon partial or marginal achievement of the critical cooling rate in cast articles, when the crystalline phase (at rates less than the critical cooling rate) is an intermetallic phase with a body-centered cubic (bcc) crystalline structure. An example of such an intermetallic phase is $Zr_{50}Cu_{50}$ phase, which can be found in Zr—Cu phase diagram at temperatures from about 715° C. to about 935° C. The bcc phase has higher toughness than the other forming crystalline intermetallic phases and provide better resistance to brittleness in the overall cast structure when cooling is less than the critical cooling rate.

In certain embodiments, the present technology is directed to alloys of zirconium-based bulk metallic glass can comprise zirconium (Zr) in the range of from about 40 to about 56 atomic percent and copper (Cu) in the range of from about 30 to about 50 atomic percent. In one embodiment, a zirconium-based bulk metallic glass comprises Zr in the range of from about 44 to about 52 atomic percent and Cu in the range of from about 34 to about 40 atomic percent. In other embodiments, a zirconium-based bulk metallic glass comprises Zr, Cu, and two or more elements from Ni, Fe, Co, Nb, Ti, Be, and Al. In a particular embodiment, an alloy comprises Zr, Cu, Al, at least one element from Ni, Fe, and Co, and at least another element from Nb and Ti. In one embodiment, a zirconium-based bulk metallic glass comprises Zr, Cu, Al and one or more of Ti and Nb. The ratio of Al/(Ti+Nb) is in the range of from about 1 to about 3. In a another embodiment, the ratio of Al/(Ti+Nb) is in the range of from about 1.5 to about 2.5.

In other embodiments, the present technology is directed to alloys of zirconium-based bulk metallic glass that has an intermetallic phase of body centered cubic ("bcc") structure in an otherwise substantially amorphous matrix when cooled at rates from about 30% to about 120% of a corresponding critical cooling rate. The alloy can have a critical casting diameter of about 5 mm to about 40 mm. The alloy can have an approximate formula of $(Zr, ETM)_{50}(Cu, LTM, Al)_{50}$. As used herein, ETM refers to one or more elements from the group of Nb, Ti, Ta, V, Mo, Cr, Hf, and Y; and LTM refers to one or more elements from the group of Fe, Co, and Ni.

In further embodiments, the present technology is directed to articles cast from a zirconium-based bulk metallic glass. Any portion of the cast articles can have an elastic strain limit of about 1.0% to about 2.2%. In one example, a cast article can have a section thickness of at least about 2.0 mm, and any portion of the cast article has a bend ductility of more than about 4.0% at section thickness more than 2.0 mm. In another example, any portion of the cast article can have an elastic strain limit of about 1.0% to about 2.2% when cooled at rates from about 30% to about 100% of a corresponding critical cooling rate. In a preferred embodiment, any portion of the cast article has an elastic strain limit of 1.5% and a bend ductility of more than 4% at section thickness of more than 2.0 mm.

Details of embodiments of alloys, cast articles of the alloys, and methods of making the cast articles are described below. In this disclosure, unless otherwise noted, a metallic glass object with substantially fully amorphous phase is defined as having about 95% to about 100% amorphous phase by volume. For example, a substantially fully amorphous metallic glass object can have about at least 95% amorphous phase by volume. Alloys and/or alloy formulations, unless otherwise noted, are described in atomic percentages, and ratios are based on atomic percentages. As used herein, zirconium-based alloy generally refers to a metallic alloy with Zr content of more than about 35 atomic percent. Bulk metallic glass ("BMG") generally refers to an alloy of metallic glass, which can be cast into a metallic glass object as a cylindrical rod with a diameter of 5 mm to about 100 mm, or in other suitable shapes.

The metallic glass objects can be produced by using a variety of methods, such as metallic mold casting, in which a piece of BMG alloy in molten state is injected into a metallic mold (e.g. copper or steel). Other processes and casting methods may also be utilized. The metallic glass objects can also be produced in the presence of reinforcement materials, such as refractory metals (e.g. Ta, W, Nb, etc.) and ceramics (e.g. SiC), to form objects of hybrid and/or composite materials. The reinforcements can be in various shapes and forms such as wires and particulates.

Alloy Compositions

As discussed above, alloy compositions of zirconium-based bulk metallic glasses in accordance with embodiments of the present technology have resistance to brittleness upon partial or marginal achievement of the critical cooling rate in cast articles of bulk metallic glasses. Alloys of the present technology may form substantially fully amorphous phase when being cast and solidified at rates higher than the critical cooling rate. When cooling rates higher than the critical cooling rate are not achieved, either due to larger dimensions of cast articles or process control deficiencies, crystalline phases formed in the castings. The crystalline phases can have fracture toughness of more than 10 MPa-m$^{1/2}$ and yield strength of more than 0.8 GPa, resulting in resistance to brittleness in the cast articles.

In certain embodiments, alloys of zirconium-based bulk metallic glasses can include Zr, Cu, and two or more elements from the group of Ni, Fe, Co, Nb, Ti, and Al. A variety of other elements can also be added, or substituted, into the group of elements. For example, additional elements may include Ta, Mo, Y, V, Cr, Sc, Be, Si, B, Zn, Pd, Ag, and Sn, some of which may be added in substantial amount. For instance, Be may be added up to 20 atomic percent and may substitute one or more of Cu, Ni, and Al in these alloys. On the other hand, elements such as Si and B, may be added at modest amounts, e.g., at 3 atomic percent or less. In certain embodiments, the alloys of the present technology are quaternary (four components) alloy systems, in which each component can be about 3 atomic percent to about 55 atomic percent. In other embodiments, the alloys can be quinary (five components) or higher order alloy systems, in which each of at least three components is about 3 atomic percent to about 55 atomic percent.

In certain embodiments, the alloys of the present technology can be described by the following generic formula:

$$Zr_a(Nb,Ti)_bCu_c(Ni,Fe,Co)_dAl_ePPP_fQQQ_gRRR_h$$

In the above formula, and in other formulas herein, the parentheses indicate that the alloy may include at least one element from the elements within the corresponding parentheses. For example, an alloy according to the foregoing formula may include Nb, Ti, or a combination of Nb and Ti. Also, PPP denotes elements (e.g. Hf, Ta, V, Be, Pd, Ag), which generally does not alter the glass forming ability of the base alloy. Pd and Ag may slightly improve the glass forming ability, while Be may improve the glass forming significantly in other select cases. QQQ denotes elements (e.g. Y, Si, Sc), which may improve the bulk glass forming ability of the base alloy when added in small amounts by, for example, remedying the negative effect of oxides in the alloy. RRR denotes any other element, which is typically not essential for the purposes of bulk glass forming ability when added in small amounts.

In certain embodiments, a is in the range of from about 36 to about 54, b is in the range of from about 0 to about 10, c is in the range of from about 30 to about 50, d is in the range of from about 0 to about 20, e is in the range of from about 0 to about 15, f is in the range of from about 0 to about 10, g is in the range of from about 0 to about 4, and h is in the range of from about 0 to about 3. In other embodiments, a is in the range of from about 40 to about 52, b is in the range of from about 0 to about 8, c is in the range of from about 30 to about 45, d is in the range of from about 0 to about 12, e is in the range of from about 4 to about 12, f is in the range of from about 0 to about 5, g is in the range of from about 0 to about 2, and h is in the range of from about 0 to about 1. In yet other embodiments, a is in the range of from about 44 to about 52, b is in the range of from about 2 to about 6, c is in the range of from about 32 to about 40, d is in the range of from about 3 to about 8, e is in the range of from about 6 to about 10, f is less than about 5, and both g and h are substantially 0. In a further embodiment, a+b is in the range of from about 45 to about 55, d+e is in the range of from about 5 to about 20, and, f+g+h is in the range of from about 0 to about 10. In yet a further embodiment, a+b is in the range of from about 48 to about 54, d+e is in the range of from about 8 to about 16, and, g+h+i is in the range of from about 0 to about 3. In another embodiment, the ratio of e/b is in the range of from about 1 to about 3, or from about 1.5 to about 2.5.

In other embodiments, alloys of the present technology can be described by the following generic formula:

$$Zr_a(Nb,Ti)_bCu_c(Ni,Fe,Co)_dAl_e$$

In certain embodiments, a is in the range of from about 36 to about 54, b is in the range of from about 0 to about 10, c is in the range of from about 30 to about 50, d is in the range of from about 0 to about 20, and e is in the range of from about 0 to about 15. In other embodiments, a is in the range of from about 40 to about 52, b is in the range of from about 0 to about 8, c is in the range of from about 30 to about 45, d is in the range of from about 0 to about 12, and e is in the range of from about 4 to about 12. In yet other embodiments, a is in the range of from about 44 to about 52, b is in the range of from about 2 to about 6, c is in the range of from about 32 to about 40, d is in the range of from about 3 to about 8, and e is in the range of from about 6 to about 10. In yet another embodiment, a+b is in the range of from about 45 to about 55 and d+e is in the range of from about 5 to about 20. In a further embodiment, a+b is in the range of from about 48 to about 54 and d+e is in the range of from about 8 to about 16. In another embodiment, the ratio of e/b is in the range of from about 1 to about 3. In another embodiment, the ratio of e/b is in the range of from about 1.5 to about 2.5.

In certain embodiments, when being cast and solidified at cooling rates from about 30% to about 200% of a corresponding critical cooling rate, the alloys of the present technology form a substantially glassy phase in portions with higher cooling rates and a mixture of glassy and crystalline phases in portions with lower cooling rates, and substantially crystalline phases in portions with the lowest cooling rate. In other embodiments, the alloys of the present technology form substantially fully amorphous phase when cooled from above its melting temperature to a temperature below its glass transition temperature at a rate higher than its critical cooling rate, and forms a mixture of glassy and intermetallic bcc phases when cooled from above its melting temperature to a temperature below its glass transition temperature at a rate in the range of from 30% to 200% of its critical cooling rate, as described in more detail below.

Cast Articles

In certain embodiments, cast articles cast and solidified at cooling rates from about 30% to about 200% of the critical cooling rate of a corresponding alloy can be described by the following generic formula:

$$Zr_aETM_bCu_cLTM_dAl_e$$

In certain embodiments, a+b is in the range of from about 47 to about 54, from about 48 to about 52, or from about 50 to about 51. In other embodiments, a is in the range of from about 36 to about 54, b is in the range of from about 0 to about 10, c is in the range of from about 30 to about 50, d is in the range of from about 0 to about 20, and e is in the range of from about 0 to about 15. In other embodiments, a is in the range of from about 40 to about 52, b is in the range of from about 0 to about 8, c is in the range of from about 30 to about 45, d is in the range of from about 0 to about 12, and e is in the range of from about 0 to about 12. In further embodiments, a is in the range of from about 44 to about 50, b is in the range of from about 0 to about 6, c is in the range of from about 32 to about 40, d is in the range of from about 0 to about 8, and e is in the range of from about 0 to about 10. In other embodiments, the cast articles can have an intermetallic phase of bcc structure. The intermetallic bcc phase can have an approximate formula of $(Zr, ETM)_{50}(Cu, LTM, Al)_{50}$. In one example, the intermetallic bcc phase has an approximate formula of $Zr_{50}Cu_{50}$.

In other embodiments, a cast article of zr-based bulk metallic glass comprises a substantially fully amorphous phase in the outer portion of cross-section of the cast article; and comprises a mixture of crystalline intermetallic bcc phase having an approximate formula of $(Zr, ETM)_{50}(Cu, LTM, Al)_{50}$ and glassy phase in the inner (center) portion of the cross-section of the cast article. In certain embodiments, such cast articles have a section thickness of at least 10 mm. In still other embodiments, a portion of a cast article of zr-based bulk metallic glass comprises a substantially fully amorphous phase, wherein the amorphous phase of the cast article has an elastic strain limit of at least 1.5%, the remaining portion of cast article of zr-based bulk metallic glass comprises a crystalline intermetallic bcc phase having an elastic strain limit of at least 0.5%.

In certain embodiments, the cast article has a section thickness up to 10 mm. In other embodiments, the cast article has a section thickness of up at least 5 mm. In still other embodiments, the cast article has a section thickness from about 5 mm up to 20 mm. In still other embodiments, the cast article has a section thickness from about 10 mm up to 50 mm.

In other embodiments, cast articles of the present technology may accommodate significant amounts of oxygen impurities from about 100 parts per million by weight (ppm) up to about 2,000 ppm, and thus allowing the use of lower quality cast feedstock and raw materials, such as scrap alloys and/or sponge zirconium. For example, a cast article can be formed from an alloy composition comprising zirconium (Zr), copper (Cu), aluminum, at least one element from a group consisting of niobium (Nb) or titanium (Ti), and at least one element from a group consisting of nickel (Ni), iron (Fe), or cobalt (Co). A concentration of the zirconium is from about 40 to about 56 atomic percent; a concentration of the copper is from about 30 to about 50 atomic percent; and the concentration of oxygen is from about 100 ppm up to about 2,000 ppm. In other examples, an alloy of cast article can have a Be content of less than about 5 atomic percent, and an oxygen content from about 200 ppm up to about 2,000 ppm. In further examples, an alloy of cast article can have a Be content of less than about 1 atomic percent, and an oxygen content from about 400 ppm up to about 1,000 ppm. In a particular example, a cast article of the present technology has a formula of Zra(Nb,Ti)bCuc(Ni,Fe,Co)dAle, where:

a is from about 36 to about 54;
b is from about 0 to about 10;
c is from about 30 to about 50;
d is from about 0 to about 20; and
e is from about 0 to about 15.

The cast article further comprises oxygen of from about 200 ppm to about 2000 ppm. In another particular example, the oxygen is from about 400 to about 1000 ppm.

Methods of Making

Additional aspects of the present technology are directed to methods of making cast articles from alloys of zirconium-based bulk metallic glass. In one embodiment, the method includes cooling an alloy from a temperature above its melting temperature to a temperature below its glass transition temperature at a rate higher than its critical cooling rate throughout the cast article to form a substantially fully amorphous metallic object. In another embodiment, the method includes cooling the alloy from above its melting temperature to a temperature below its glass transition temperature at a rate in the range of from about 30% to about 300%, about 50% to about 200%, about 80% to about 200%, about 50% to about 150%, about 80% to about 120%, or about 30% to about 120% of the critical cooling rate. As a result, a substantially fully amorphous phase may be formed in the outer portion of cross-section of the cast article, and a mixture of glassy and crystalline phases may be formed in the inner portion of the cross-section of the cast article. The crystalline phase has an approximate formula of $(Zr, ETM)_{50}(Cu, LTM, Al)_{50}$ and may be an intermetallic bcc phase.

In some embodiments, a method of forming a cast article of zr-based bulk metallic glass can include:

i) Providing an alloy of zr-based bulk metallic glass comprising Zr and Cu;
ii) Heating the alloy above the thermodynamic melting temperature of the alloy;
iii) Cooling at least a portion of the molten alloy from above its melting temperature to a temperature below its glass transition temperature at a rate in the range of from about 30% to about 200% of the critical cooling rate to form a substantially fully amorphous phase in the outer portion of cross-section of the cast article, and a mixture of glassy and crystalline intermetallic bcc phases in the inner portion of the cross-section of the cast article. The crystalline phase has an approximate formula of $(Zr, ETM)_{50}(Cu, LTM, Al)_{50}$.

In other embodiments, a method of forming a cast article of Zr-based bulk metallic glass can include:

i) Providing an alloy of zr-based bulk metallic glass comprising Zr, Cu and two or more elements from the group of (Ni, Fe, Co, Nb, Ti, Be and Al)
ii) Heating the alloy above a thermodynamic melting temperature of the alloy; and
iii) Cooling the entire alloy from above its melting temperature to a temperature below its glass transition temperature at a rate in the range of from about 30% to about 200% of the critical cooling rate to form a substantially fully amorphous phase in the outer portion of cross-section of the cast article, and a mixture of glassy and intermetallic bcc phases in the inner portion of the cross-section of the cast article. The intermetallic bcc phase has an approximate formula of $(Zr)_{50}(Cu)_{50}$.

In the foregoing embodiments, the alloy can have a formula of $Zr_a(Nb,Ti)_bCu_c(Ni,Fe,Co)_dAl_e$ where, a is in the range of from about 36 to about 54, b is in the range of from about 0 to about 10, c is in the range of from about 30 to about 50, d is in the range of from about 0 to about 20, and e is in the range of from about 0 to about 15. In other embodiments, the alloy can have a formula of $Zr_a(Nb,Ti)_bCu_c(Ni,Fe,Co)_dAl_e$ where, a is in the range of from about 36 to about 54, b is in the range of from about 0 to about 10, c is in the range of from about 30 to about 50, d is in the range of from about 0 to about 20, and e is in the range of from about 0 to about 15.

Examples

Alloys in accordance with several embodiments of the present technology were formed and tested for susceptibility to brittleness, as described below.

$$Zr_{48}Ti_4Cu_{36}Ni_4Al_8$$

An alloy of the above formulation was prepared by using a laboratory arc-melter fusing elemental metals. The alloy is re-melted under protective atmosphere and quenched to form a long cylindrical rod of about 12 mm in diameter. A metallographic sample was prepared by slicing a circular cross-section of the 12 mm diameter rod. The center portion of the cross-section of the rod exhibited substantial crystalline phase formation as confirmed by both optical microscopy and X-ray diffraction. The edge of the cross-section, the circumference portion of the rod, exhibited primarily glassy phase formation as confirmed by both optical microscopy and X-ray diffraction.

Rockwell hardness tests (Rockwell A scale using 60 kgf load) were performed throughout the circular slice representing the cross-section of 12 mm diameter rod casting. Rockwell hardness indentations performed around the edge of the sample, where the cooling rate is highest, exhibited out-arching shear bands indicating full amorphous phase formation and no brittle crack-formation. Rockwell hardness indentations performed around the center of the sample, where the cooling rate is lowest, exhibited no shear bands indicating lack of any amorphous phase formation. Furthermore, Rockwell hardness indentations performed around the center of the sample, where the cooling rate is lowest, exhibited plastic deformation of typical crystalline metals and no significant crack-formation. Accordingly, a relatively strong and tough crystalline phase was formed in portions with the lowest cooling rate precluding any brittleness in the cast article of alloy $Zr_{48}Ti_4Cu_{36}Ni_4Al_8$.

$$Zr_{50}Nb_3Cu_{34}Ni_4Al_9$$

An alloy of the above formulation was prepared by using a laboratory arc-melter fusing elemental metals. The alloy was re-melted under protective atmosphere and quenched to form a long cylindrical rod of about 12 mm in diameter. A metallographic sample was prepared by slicing a circular cross-section of the 12 mm diameter rod. The full cross-section of the sample exhibited primarily glassy phase formation as confirmed by both optical microscopy and X-ray diffraction. Rockwell hardness tests (Rockwell A scale using 60 kgf load) were performed throughout the circular slice representing the cross-section of 12 mm diameter rod casting. Rockwell hardness indentations performed throughout of the sample all exhibited out-arching shear bands indicating full amorphous phase formation and no brittle crack-formation.

A long cylindrical rod of about 16 mm in diameter was prepared using the same method and alloy formulation. A metallographic sample was prepared by slicing a circular cross-section of the 16 mm diameter rod. The center portion of the cross-section of the rod exhibited substantial crystalline phase formation as confirmed by both optical microscopy and X-ray diffraction. The edge of the cross-section, the circumference portion of the rod, exhibited primarily glassy phase formation as confirmed by both optical microscopy and X-ray diffraction. Rockwell hardness tests (Rockwell A scale using 60 kgf load) were performed throughout the circular slice representing the cross-section of 16 mm diameter rod casting. Rockwell hardness indentations performed around the edge of the sample, where the cooling rate is highest, exhibited out-arching shear bands indicating full amorphous phase formation and no brittle crack-formation. Rockwell hardness indentations performed around the center of the sample, where the cooling rate is lowest, exhibited no shear bands indicating lack of any amorphous phase formation. Furthermore, Rockwell hardness indentations performed around the center of the sample, where the cooling rate is lowest, exhibited plastic deformation of typical crystalline metals and no significant crack-formation. Thus, a relatively strong and tough crystalline phase was formed in portions with the lowest cooling rate precluding any brittleness in the cast article of alloy $Zr_{50}Nb_3Cu_{34}Ni_4Al_9$.

From the foregoing, it will be appreciated that specific embodiments of the disclosure have been described herein for purposes of illustration, but that various modifications may be made without deviating from the disclosure. In addition, many of the elements of one embodiment may be combined with other embodiments in addition to or in lieu of the elements of the other embodiments. Accordingly, the technology is not limited except as by the appended claims.

We claim:

1. A metallic glass composition comprising zirconium (Zr), copper (Cu), aluminum (Al), at least one element from a group consisting of niobium (Nb) and titanium (Ti), and at least one element from a group consisting of nickel (Ni), iron (Fe), and cobalt (Co), wherein a concentration of the zirconium is from about 40 to about 56 atomic percent, and wherein a concentration of the copper is from about 30 to about 50 atomic percent, and wherein the metallic glass composition has a formula of $Zr_a(Nb,Ti)_bCu_c(Ni,Fe,Co)_dAl_e$, and further wherein a ratio of e/b is about 1 to about 3 or about 1.5 to about 2.5.

2. The metallic glass composition of claim 1 wherein,
a is from about 36 to about 54;
b is from about 0 to about 10;
c is from about 30 to about 50;
d is from about 0 to about 20; and
e is from about 0 to about 15.

3. The metallic glass composition of claim 1 wherein,
a is from about 40 to about 52;
b is from about 0 to about 8;
c is from about 30 to about 45;
d is from about 0 to about 12; and
e is from about 4 to about 12.

4. The metallic glass composition of claim 1 wherein,
a+b is from about 45 to about 55; and
d+e is from about 5 to about 20.

5. The metallic glass composition of claim 1 wherein the metallic glass composition further includes at least one of hafnium (Hf), tantalum (Ta), vanadium (V), beryllium (Be), palladium (Pd), or silver (Ag), and at least one of yttrium (Y), silicon (Si), or scandium (Sc).

6. An article formed from a metallic glass composition comprising zirconium (Zr), copper (Cu), aluminum, at least one element from a group consisting of niobium (Nb) or titanium (Ti), and at least one element from a group consisting of nickel (Ni), iron (Fe), or cobalt (Co), wherein a concentration of the zirconium is from about 40 to about 56 atomic percent, and wherein a concentration of the copper is from about 30 to about 50 atomic percent, and wherein the metallic glass composition has a formula of $Zr_a(Nb,Ti)_bCu_c(Ni,Fe,Co)_dAl_e$, and further wherein a ratio of e/b is about 1 to about 3.

7. The article of claim 6 wherein the metallic glass composition comprises from about 200 ppm to about 2,000 ppm oxygen.

8. The article of claim 6 wherein,
a is from about 36 to about 54;
b is from about 0 to about 10;
c is from about 30 to about 50;
d is from about 0 to about 20; and
e is from about 0 to about 15.

9. The article of claim 8 wherein the metallic glass composition comprises from about 400 ppm to about 1,000 ppm oxygen.

10. The article of claim 6 wherein,
a+b is from about 45 to about 55; and
d+e is from about 5 to about 20.

11. The article of claim 6 wherein the ratio of e/b is about 1.5 to about 2.5.

12. An article of zirconium based bulk metallic glass having zirconium (Zr), copper (Cu), aluminum (Al), at least one element from a group consisting of niobium (Nb), titanium (Ti), tantalum (Ta), vanadium (V), molybdenum (Mo), chromium (Cr), hafnium (Hf), and yttrium (Y), and at least one element from a group consisting of nickel (Ni), iron (Fe), or cobalt (Co), wherein the article has a substantially fully amorphous phase in an outer portion of a cross-section of the article and a mixture of (i) a crystalline intermetallic body centered cubic phase and (ii) a glassy phase in an inner portion of the cross-section of the article.

13. The article of claim 12 wherein the zirconium based bulk metallic glass has a formula of ZraETMbCucLTMdAle, where ETM is the group consisting of niobium (Nb), titanium (Ti), tantalum (Ta), vanadium (V), molybdenum (Mo), chromium (Cr), hafnium (Hf), and yttrium (Y), and LTM is the group consisting of nickel (Ni), iron (Fe), or cobalt (Co), and wherein a+b is from about 47 to about 54.

14. The article of claim 12 wherein the zirconium based bulk metallic glass has a formula of ZraETMbCucLTMdAle, where ETM is the group consisting of niobium (Nb), titanium (Ti), tantalum (Ta), vanadium (V), molybdenum (Mo), chromium (Cr), hafnium (Hf), and yttrium (Y), and LTM is the group consisting of nickel (Ni), iron (Fe), or cobalt (Co), and wherein a+b is from about 48 to about 52.

15. The article of claim 12 wherein the zirconium based bulk metallic glass has a formula of ZraETMbCucLTMdAle, where ETM is the group consisting of niobium (Nb), titanium (Ti), tantalum (Ta), vanadium (V), molybdenum (Mo), chromium (Cr), hafnium (Hf), and yttrium (Y), and LTM is the group consisting of nickel (Ni), iron (Fe), or cobalt (Co), and wherein a+b is from about 50 to about 51.

16. The article of claim 12 wherein the zirconium based bulk metallic glass has a formula of ZraETMbCucLTMdAle, where ETM is the group consisting of niobium (Nb), titanium (Ti), tantalum (Ta), vanadium (V), molybdenum (Mo), chromium (Cr), hafnium (Hf), and yttrium (Y), and LTM is the group consisting of nickel (Ni), iron (Fe), or cobalt (Co), and wherein a+b is about 50 and c+d+e is about 50.

17. A cast article of Zr-based bulk metallic glass comprising a substantially fully amorphous phase in an outer portion of a cross-section of the cast article and a mixture of (i) a crystalline intermetallic body centered cubic phase having an approximate formula of (Zr, ETM)50(Cu, LTM, Al)50 and (ii) a glassy phase in an inner portion of the cross-section of the cast article, where ETM is the group consisting of niobium (Nb), titanium (Ti), tantalum (Ta), vanadium (V), molybdenum (Mo), chromium (Cr), hafnium (Hf), and yttrium (Y), and LTM is the group consisting of nickel (Ni), iron (Fe), or cobalt (Co).

18. The cast-article of claim 17 wherein cast article further comprises from about 200 ppm to about 2,000 ppm oxygen.

19. The cast article of claim 17 wherein the cast article has a section thickness of at least 10 mm.

20. The cast-article of claim 17 wherein the alloy comprises from about 400 ppm to about 1,000 ppm oxygen, and wherein the cast article has a section thickness of at least about 10 mm.

21. The cast article of claim 17 wherein the amorphous phase of the cast article has an elastic strain limit of at least about 1.5%, and wherein the crystalline intermetallic body centered cubic phase has an elastic strain limit of at least about 0.5%.

* * * * *

UNITED STATES PATENT AND TRADEMARK OFFICE

CERTIFICATE OF CORRECTION

PATENT NO. : 9,334,553 B2
APPLICATION NO. : 13/847759
DATED : May 10, 2016
INVENTOR(S) : Atakan Peker et al.

It is certified that error appears in the above-identified patent and that said Letters Patent is hereby corrected as shown below:

In the Specification
Column 1, lines 10 through 15 inclusive, the text under STATEMENT REGARDING FEDERALLY-SPONSORED RESEARCH that reads "This work was made with support provided by the U.S. Department of Defense. The U.S. government has certain rights in the invention.." should be changed to --This work was made with support provided by the U.S. Department of Defense, through Office of Naval Research, grant number N00014-06-1-0315. The U.S. government has certain rights in the invention.--

Signed and Sealed this
Twenty-eighth Day of June, 2016

Michelle K. Lee

Michelle K. Lee
*Director of the United States Patent and Trademark Office*